US005157301A

United States Patent [19]

Tominaga et al.

[11] Patent Number: 5,157,301

[45] Date of Patent: Oct. 20, 1992

[54] COLOR CATHODE RAY TUBE UNIT

[75] Inventors: Noboru Tominaga, Takatsuki; Katsuyo Iwasaki, Nishinomiya; Hidekuni Fujisawa, Kyoto; Koichi Sugahara, Sakai; Hiroshi Suzuki, Nagaokakyo, all of Japan

[73] Assignee: Matsushita Electronics Corporation, Osaka, Japan

[21] Appl. No.: 594,881

[22] Filed: Oct. 9, 1990

[30] Foreign Application Priority Data

Oct. 16, 1989 [JP] Japan ..... 1-268471

[51] Int. Cl.[5] ..... H01J 29/70; H01J 29/76

[52] U.S. Cl. ..... 313/412; 315/368.11

[58] Field of Search ..... 313/412; 315/368

[56] References Cited

U.S. PATENT DOCUMENTS 4,319,163 3/1982 Chen ..... 315/14
4,725,763 2/1988 Okuyama et al. ..... 313/412
4,731,563 3/1988 Bloom et al. ..... 315/382
4,771,216 9/1988 Blacker et al. ..... 315/368
4,877,998 10/1989 Maninger et al. ..... 315/15
4,988,926 1/1991 Sluyterman et al. ..... 315/368

FOREIGN PATENT DOCUMENTS 64-65753 3/1989 Japan .

*Primary Examiner*—Donald J. Yusko
*Assistant Examiner*—Diab Hamadi
*Attorney, Agent, or Firm*—Panitch Schwarze Jacobs & Nadel

[57] ABSTRACT

A color cathode ray unit which includes an in-line type electron gun, a deflection yoke disposed on the color CRT so as to generate substantially uniform horizontal and vertical deflection magnetic fields, thereby ensuring that an axially unsymmetrical lens electric field is dynamically generated between a first and a second focusing grid thereby correcting a distortion of electron beams caused by a magnetic field leaking from a dynamic convergence means.

2 Claims, 8 Drawing Sheets

COLOR CATHODE RAY TUBE UNIT

BACKGROUND OF THE INVENTION

1. Field of the Invention

The present invention relates to a color cathode ray tube (CRT) unit having an in-line type electron gun, a deflection yoke disposed on the color CRT so as to generate substantially uniform horizontal and vertical deflection magnetic fields, and a dynamic convergence yoke disposed near the front portion of the in-line type electron gun so as to apply a horizontal outward deflection force to two side electron beams passing therethrough, thus ensuring high resolution over the whole area of a phosphor screen thereof.

2. Description of the Prior Art

In general, a deflection yoke disposed on a color CRT having an in-line type electron gun generates a horizontal deflection magnetic field distorted in a pincushion shape and a vertical deflection magnetic field distorted in a barrel shape. Such a color CRT is capable of providing itself with a self convergence structure, thereby eliminating the necessity of a dynamic convergence circuit and allowing simplification of the circuit structure and reduction of power consumption.

However, since both the horizontal and vertical deflection magnetic fields are non-uniform, electron beams passing through these fields are distorted in their sectional shape as the deflection angle thereof becomes widened. This causes distortion of beam spots into a non-circular shape on a phosphor screen of the color CRT, especially on the peripheral area thereof, thereby deteriorating the resolution on the area.

In order to prevent the deterioration of resolution due to the above-described deflection distortion, Japanese Laid-Open Patent Publication No. 64-65753 proposes a system in which a deflection yoke generating substantially uniform horizontal and vertical deflection magnetic fields is disposed on a color CRT having an in-line type electron gun while misconvergence in the horizontal direction caused by the uniform deflection magnetic fields is corrected by a means of dynamic convergence.

Under the proposed system, as shown in FIG. 11 and FIG. 12, a color CRT 1 is provided with a top unit 3 for dynamic convergence at the front end of an in-line type electron gun 2. The top unit 3 includes in its cup-shaped body 4 made of non-magnetic metal, two pairs of magnetic members 5*a* and 5*b* and 6*a* and 6*b*, and a pair of magnetic shield members 7*a* and 7*b*. Dynamic convergence yokes 8*a* and 8*b* magnetically coupled with the pairs of magnetic members 5*a* and 5*b* and 6*a* and 6*b* respectively are disposed outside the tube. Each magnetic excitation coil of the yokes 8*a* and 8*b* receives a parabolic current which increases as the deflection angle of electron beams is widened, and, accordingly, side electron beams B and R are subjected to a horizontal outward deflection force. Reference numerals 9*a*, 9*b* and 9*c* denote three horizontally lined cathodes. The reference numerals 10, 11, 12, 13, 14 and 15 denote a control grid, an accelerating grid, a focusing grid, an anode, a phosphor screen and a deflection yoke which generates substantially uniform horizontal and vertical deflection magnetic fields, respectively.

The color CRT constructed in this way is advantageously effective to prevent the beam spots from being distorted on the peripheral area of the phosphor screen 14. However, the disadvantage is that a "dynamic focusing effect" is unavoidably caused; more specifically, as the deflection angle is widened so as to minimize the horizontal diameter of the beam spots, the parabolic dynamic voltage rises. If it is applied to a focusing electrode 12, the shapes of beam spots on the phosphor screen 14, especially those formed on the peripheral area thereof, are distorted, as shown in FIG. 13.

Referring to FIG. 14, the reason why this distortion is caused will be described:

When a dynamic current flows through the coils 16*a* and 16*b* of the yokes 8*a* and 8*b* respectively. a four-pole magnetic field is generated. This magnetic field generates uniform two-pole magnetic fields between two pairs of magnetic members 5*a* and 5*b* and 6*a* and 6*b*, respectively, as shown in FIG. 12. As a result, each of two side electron beams B and R receives a horizontal outward deflection force. However, in areas where such magnetic members are not disposed, that is, at both sides of the phosphor screen in the top unit 3 and toward the anode thereof, the four-pole magnetic fields leaking from the pair of yokes 8*a* and 8*b* directly affect three electron beams B, G and R. Thus, these electron beams are caused to deflect in the directions indicated by the large arrows in FIG. 15; more specifically, these beams are urged to diverge horizontally and to focus vertically, thereby prolonging beam spots horizontally as illustrated in FIG. 16.

As discussed above, the proposed color CRT system, regardless of the fact that it is provided with deflection yoke which generate substantially uniform horizontal and vertical deflection magnetic fields, does not satisfactorily improve resolution on the peripheral area of a phosphor screen.

SUMMARY OF THE INVENTION

The color CRT unit of the present invention, which overcomes the above-discussed and numerous other disadvantages and deficiencies of the prior art, comprises a color CRT incorporating an in-line type electron gun in its neck portion, the in-line type electron gun including three horizontally aligned cathodes, a control grid, an accelerating grid, a first focusing grid, a second focusing grid and an anode, a deflection yoke disposed on the color CRT so as to generate substantially horizontal and vertical deflection magnetic fields, and a pair of dynamic convergence yokes disposed near the front portion of the in-line type electron gun so as to apply a horizontal outward deflection force to two side electron beams, the first focusing grid receiving a predetermined focusing voltage while the second focusing grid receiving a superimposed voltage on the focusing voltage of a dynamic voltage which increases as the deflection angle of electron beams becomes widened, the first focusing grid having three in-line electron beam passage holes in the vertically prolonged non-circular shape in the side plate thereof facing the second focusing grid, the second focusing grid having three in-line electron beam passage holes in the horizontally prolonged non-circular shape in the side plate thereof facing the first focusing grid.

In a preferred embodiment, each of the first focusing grid and the second focusing grid is at least partly cylindrical.

Thus, the invention described herein makes possible the objective of providing a color CRT unit capable of achieving high resolution all over a phosphor screen.

BRIEF DESCRIPTION OF THE DRAWINGS

This invention may be better understood and its numerous objects and advantages will become apparent to those skilled in the art by reference to the accompanying drawin as follows.

DESCRIPTION OF THE PREFERRED EMBODIMENTS

Figure 1:
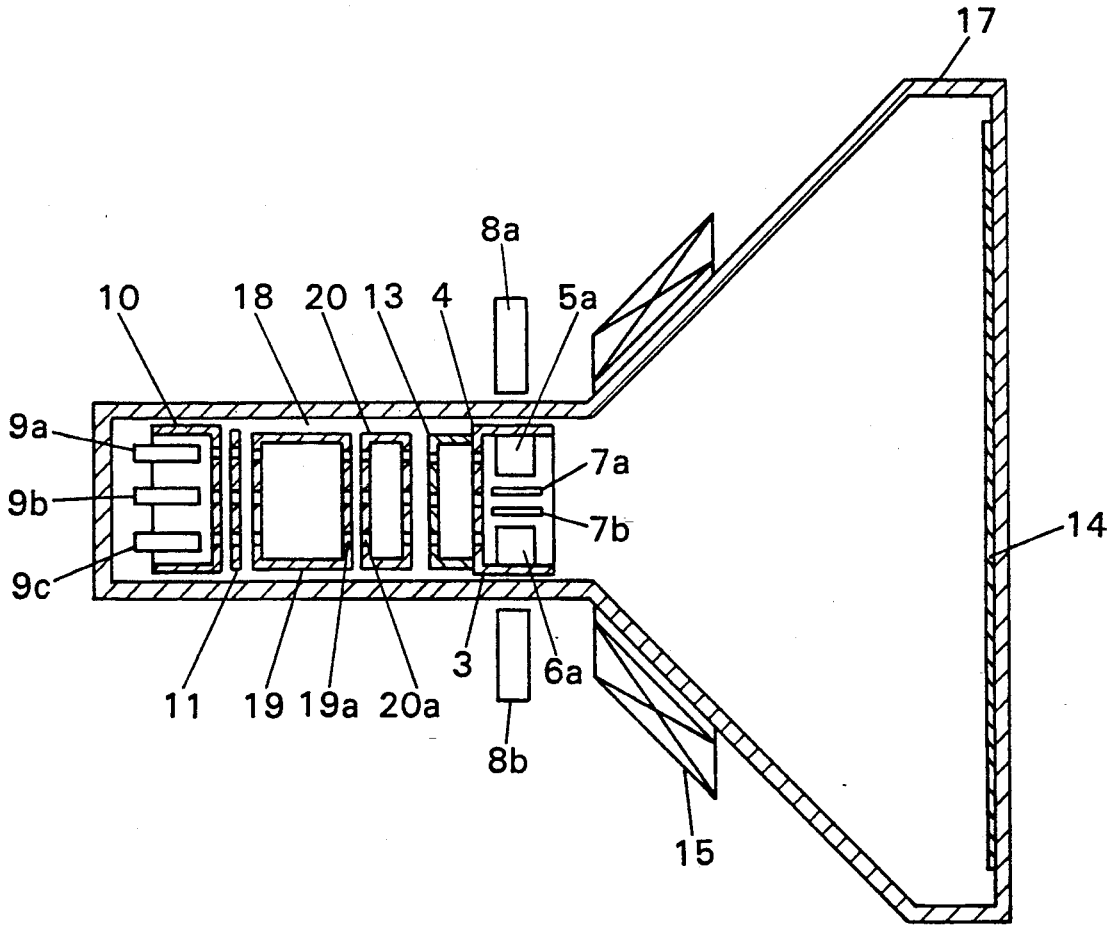
FIG. 1 is a sectional view of a color CRT unit according to the present invention.
Figure 2:
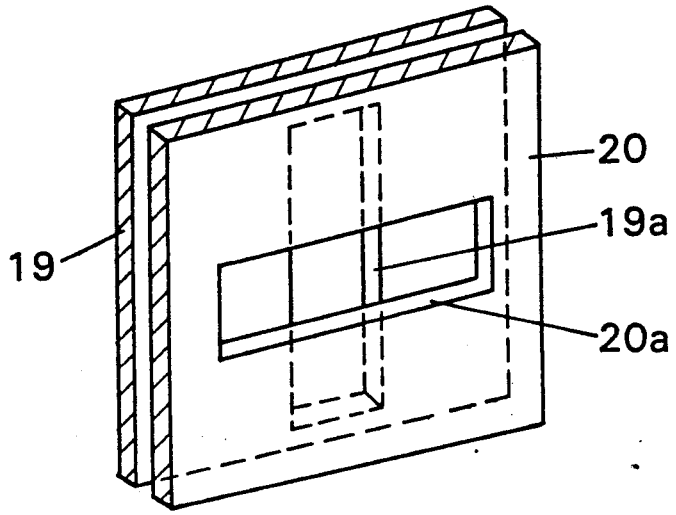
FIG. 2 is a perspective view of electron beam passage holes formed in the side plates, facing each other, of a first and a second focusing grid.
Figure 11:
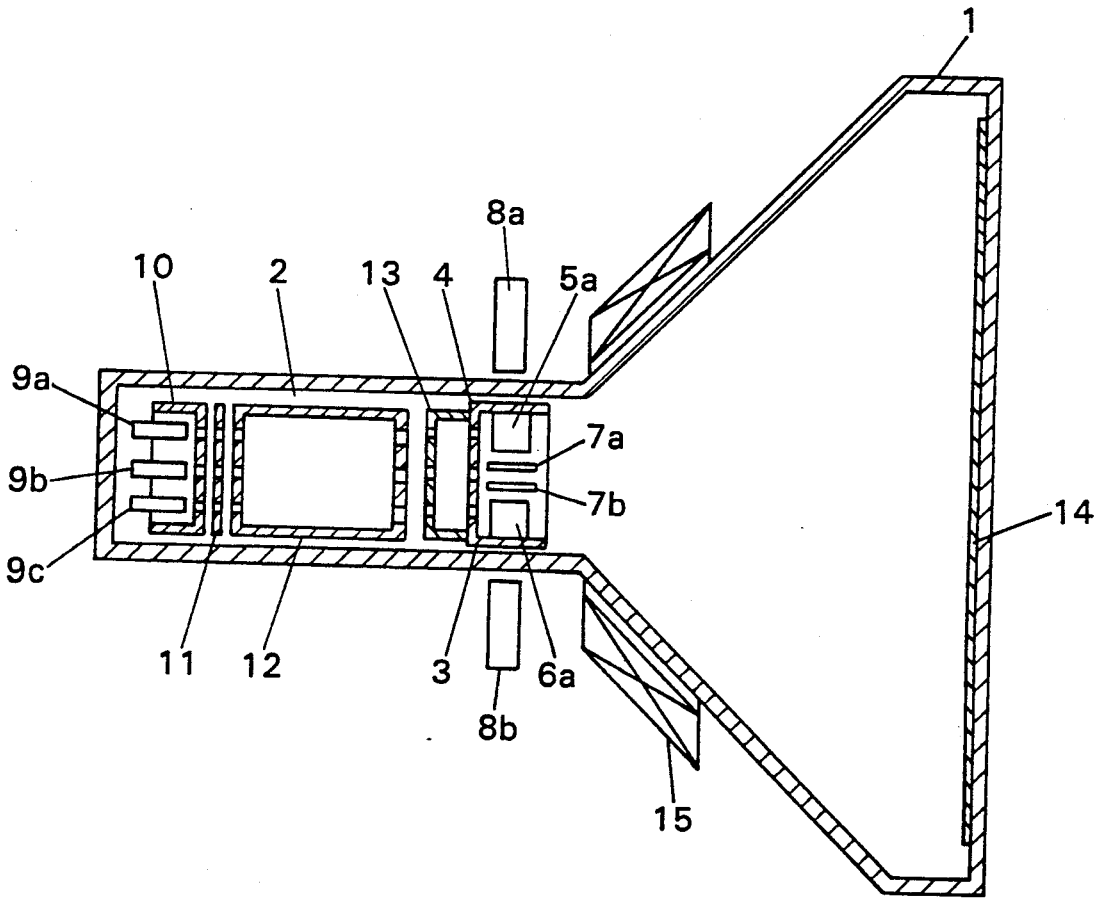
FIG. 11 is a sectional view of a conventional color CRT unit.
Figure 12:
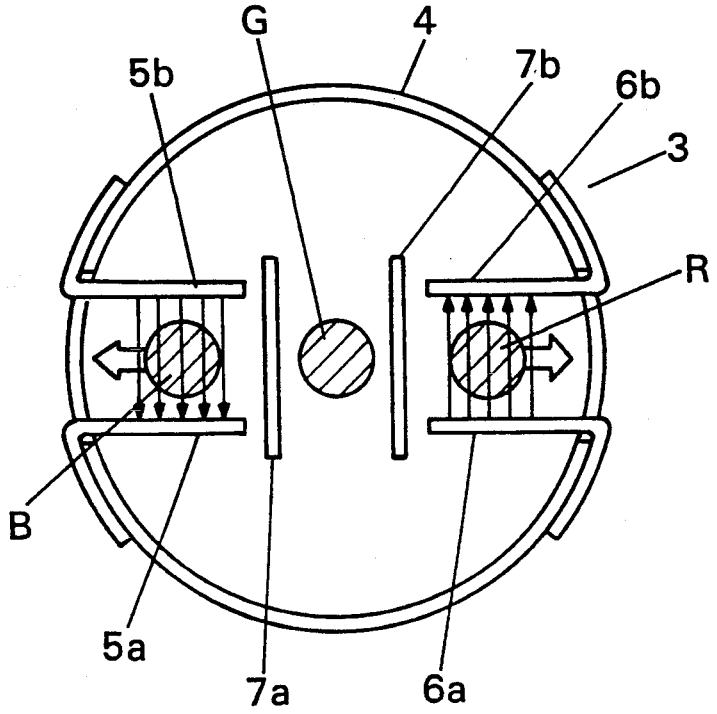
FIG. 12 is a view showing the relations between a magnetic field and a deflecting force acting on electron beams in a top unit of the conventional color CRT unit.
Figure 13:
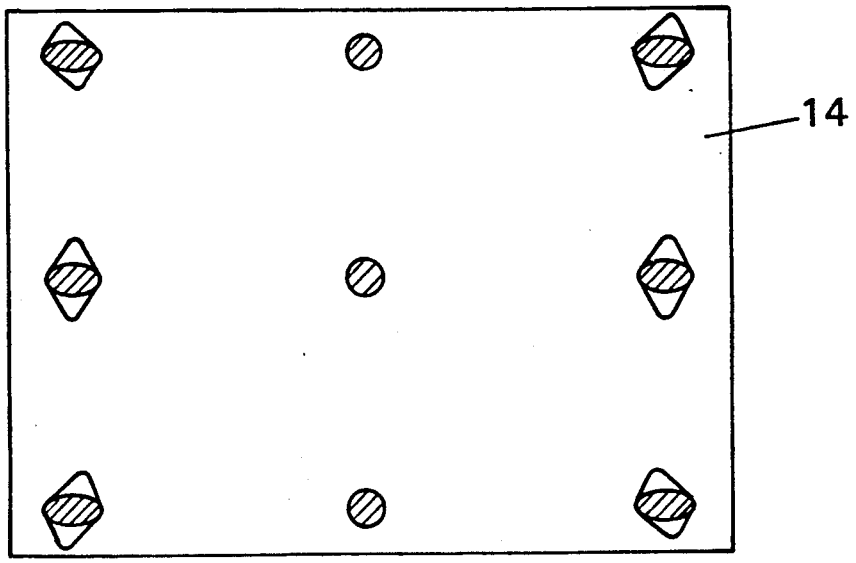
FIG. 13 is a typical illustration of distortion of beam spots on the phosphor screen.
Figure 14:
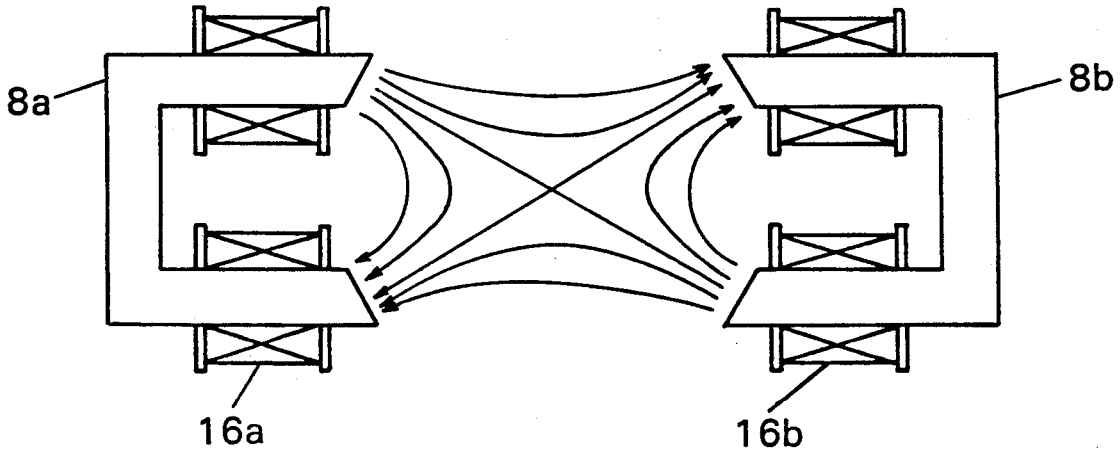
FIG. 14 is illustrating a four-pole magnetic field generated from the pair of dynamic convergence yokes.
Figure 15:
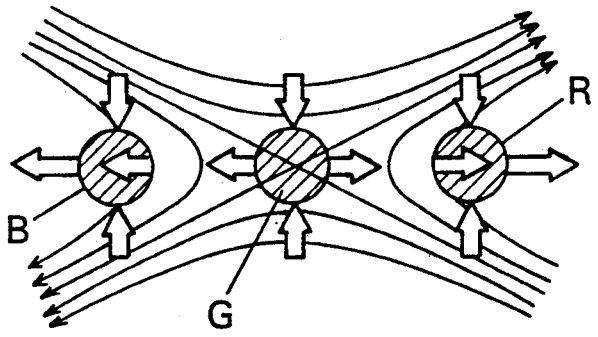
FIG. 15 is a view illustrating how electron beams are distorted by the four-pole magnetic field.

The difference of a color CRT 17 shown in FIG. 1 from the color CRT shown in FIG. 11 is that the former is provided with two separate focusing grids in an in-line type electron gun 18, a first focusing grid 19 and a second focusing grid 20. To the first focusing grid 19 a predetermined focusing voltage is applied, and to the second focusing grid 20 is applied a dynamic voltage which increases as the deflection angle of electron beams is widened and superimposed on the focusing voltage. Additionally, the first focusing grid 19 has three circle-shaped electron beam passage holes in one side plate thereof facing an accelerating grid 11 and three vertically prolonged non-circular electron beam passage holes 19*a* in the other side plate thereof facing the second focusing grid 20 as shown in FIG. 2. The second focusing grid 20 has three horizontally prolonged non-circular electron beam passage holes 20*a* in one side plate thereof facing the first focusing grid 19.

Figure 3:
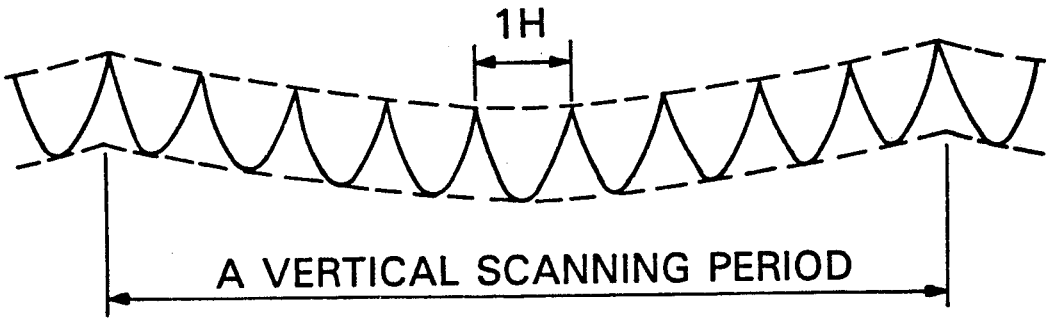
FIG. 3 is a view illustrating a wave-shaped dynamic voltage.

A superimposed voltage of a modulated signal corresponding to an image on a 120 DC voltage is applied to cathodes 9*a*, 9*b* and 9*c*, a 0 voltage to a control grid 10 and a 300–600 voltage to the accelerating grid 11, respectively. The focusing voltage applied to the first focusing grid 19 is predetermined to be approximately 8 KV. Superimposed on this focusing voltage, a wave-shaped dynamic voltage as illustrated in FIG. 3 increasing from the predetermined focusing voltage as the deflection angle of electric beams is widened, is applied to the second focusing grid 20. The maximum dynamic voltage can be set to approximately 500 V for a 29-inch 90-degree deflection type color CRT.

Figure 4:
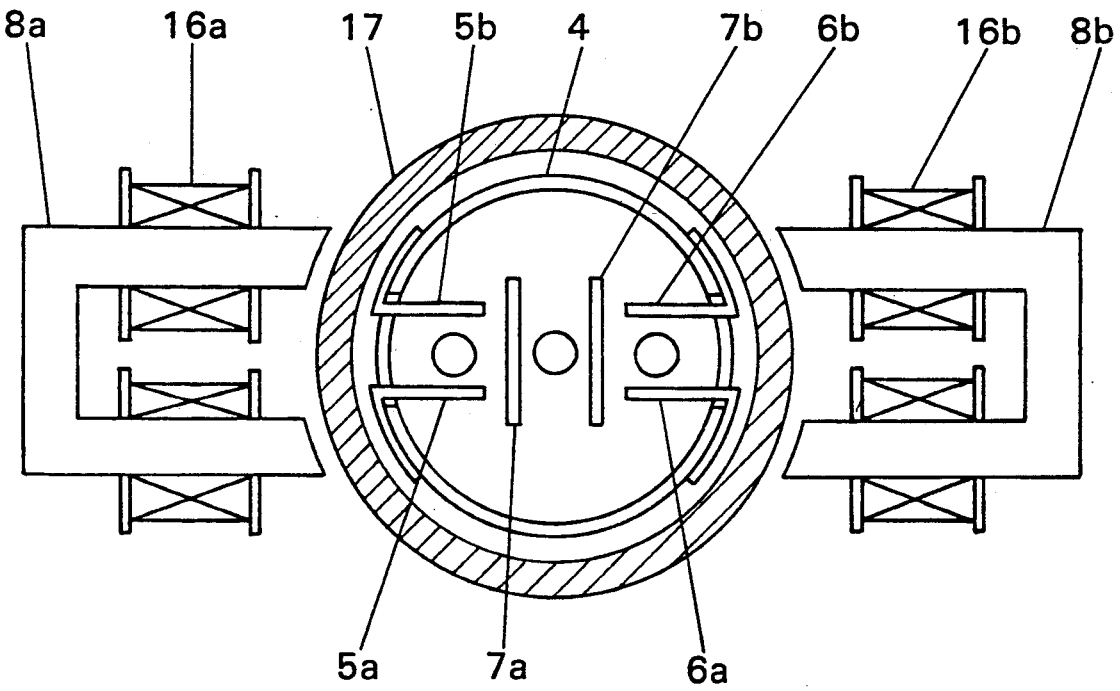
FIG. 4 is a sectional view showing the relations between a top unit and dynamic convergence yokes.

A pair of dynamic convergence yokes 8*a* and 8*b* are disposed outside the periphery of the neck portion of the color CRT 17 as shown in FIG. 4. When a dynamic current described later is applied to coils 16*a* and 16*b*, a horizontal outward deflection force is provided to two side beams B and R.

Figure 5:
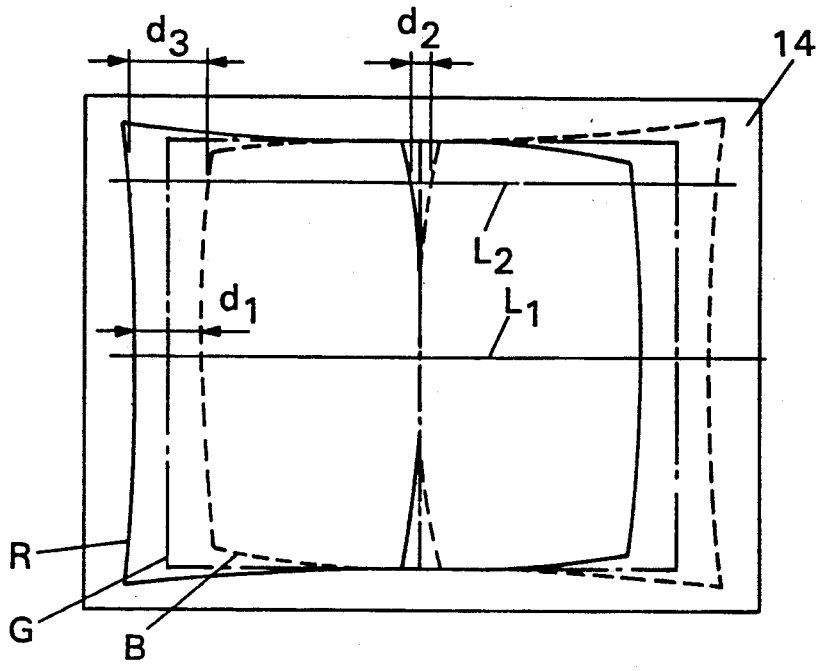
FIG. 5 is a view illustrating a screen where a misconvergence occurs.

A deflection yoke 15 generates substantially uniform horizontal and vertical deflection magnetic fields. If any means for effecting dynamic convergence is not applied, misconvergence is likely to occur on a phosphor screen 14 as shown in FIG. 5. A scanning line $L_1$ crossing the center of the phosphor screen 14 does not require correction at the center part but requires a correction current $i_1$ at the left end thereof where a misconvergence $d_1$ occurs (Refer to FIG. 6). Meanwhile, a scanning line $L_2$ requires a correction current $i_2$ to correct a misconvergence $d_2$ occurring at the center part of the phosphor screen 14 and a correction current $i_3$ ($\simeq i_1+i_2$) to cope with a misconvergence $d_3$ occurring at the left end thereof.

Figure 6:
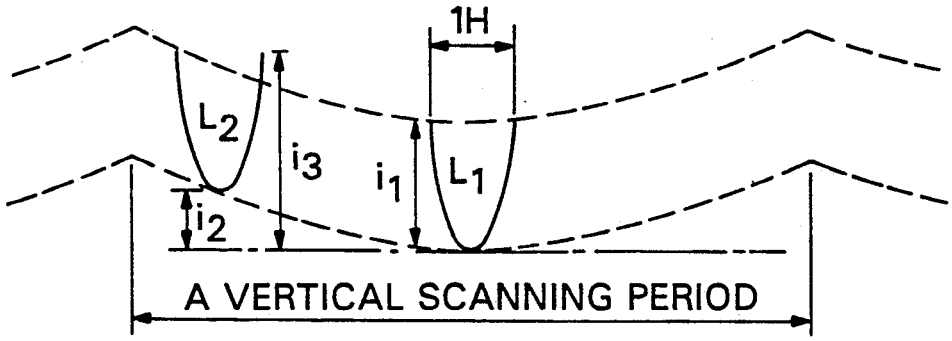
FIG. 6 is a view illustrating a wave-shaped current applied to a coil of a dynamic convergence yoke.
Figure 7:
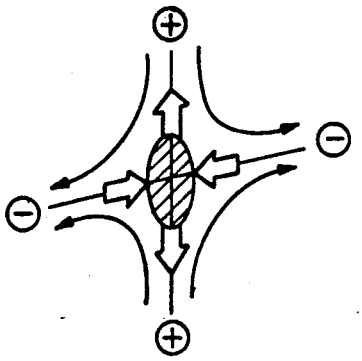
FIG. 7 is a view illustrating the distortion of an electron beam caused by a lens electric field generated between the first and the second focusing grid.

Consequently, in order to minimize the horizontal and vertical misconvergence all over the phosphor screen 14, a wave-shaped dynamic current as illustrated in FIG. 6 can be applied to the coils 16*a* and 16*b*. Incidentally, typical correction currents to be supplied to coils 16*a* and 16*b* are 20 mA horizontally, 40 mA vertically and 70 mA diagonally. The impedance at each coil is approximately 5 mH.

On the other hand, the leaked elements directly from the four-pole magnetic field generated from the pair of dynamic convergence yokes 8*a* and 8*b*, not by way of either pair of magnetic members 5*a* and 5*b* or 6*a* and 6*b*, work on three electron beams at the two side portions of a top unit 3 near the phosphor screen and near the anode, as a result, distorting the sectional shape of electron beams to a horizontally prolonged oval shape. However, this distortion can be offset by a lens electric field dynamically generated between the first and second focusing grids, because this electric field works so as to distort the sectional shape of electron beams to a vertically prolonged shape.

Figure 8A:
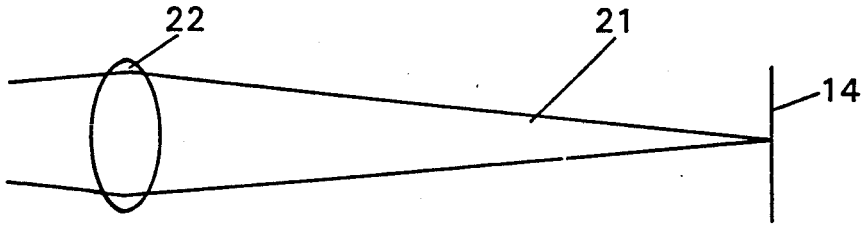
FIGS. 8(*a*) and (*b*) are respectively horizontal and vertical image forming models obtained when an electron beam impinges on the center of a phosphor screen without being subjected to deflection.
Figure 8:
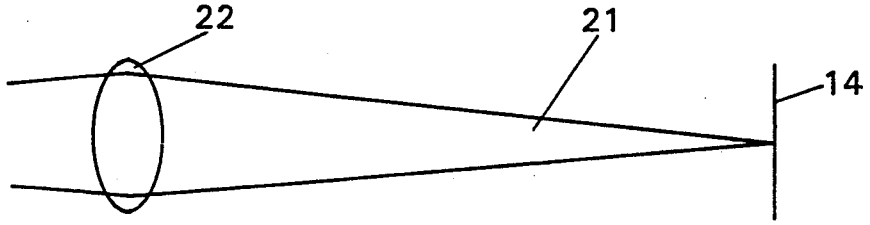
Figure 9:
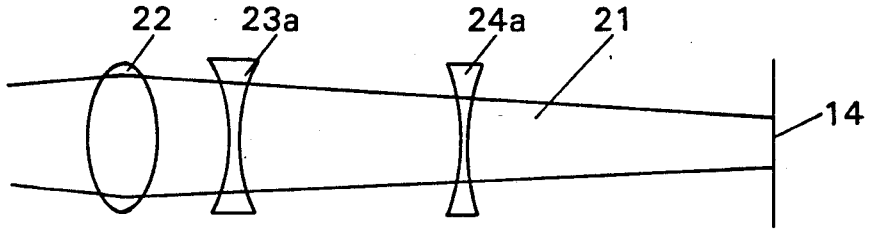
FIGS. 9(*a*) and (*b*) are horizontal and vertical models respectively obtained when misconvergence is corrected and a predetermined focusing voltage is applied to the first and second focusing grids so that the electric beam is deflected to the peripheral area of the phosphor screen.
Figure 9:
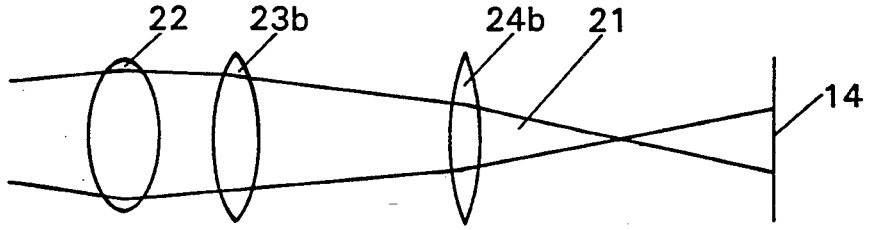

FIGS. 8(*a*) and (*b*) show horizontal and vertical image forming models respectively obtained when an electron beam hits the center of the phosphor screen 14 without being subjected to deflection. An electron beam 21 is focused, both horizontally and vertically, into one spot on the phosphor screen 14 due to convergence by a main lens electric field 22. FIGS. 9(*a*) and (*b*) show horizontal and vertical models respectively obtained when misconvergence is corrected and a predetermined focusing voltage is applied to the first and second focusing grids 19 and 20 so that the electric beam 21 is deflected to the peripheral area of the phosphor screen 14. In the horizontal model, the electron beam 21 is not focused on the phosphor screen 14 by the effects of a divergent lens 23*a* produced by the four-pole magnetic field from the dynamic convergence yokes and another divergent lens 24*a* produced by the deflection magnetic field. In the vertical model, the electron beam 21 is over-focused on the phosphor screen 14 by the effects of a focusing lens 23*b* produced by the four-pole magnetic field and another convergent lens 24*b* produced by the deflection magnetic field. Thus, when the electron beam 21 is adjusted to be focused horizontally at a spot on the phosphor screen, it is further over-focused vertically.

Figure 10:
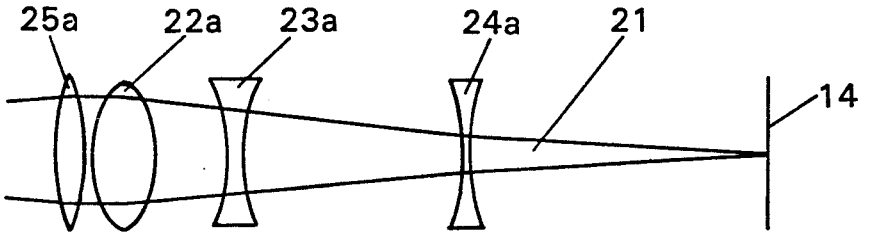
FIGS. 10(*a*) and (*b*) are horizontal and vertical image forming models respectively obtained in the embodiment of the present invention where misconvergence is corrected and a dynamic voltage is applied to the second focusing grid.
Figure 10:
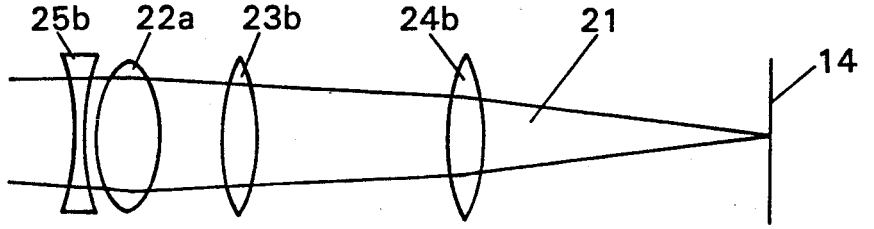

FIGS. 10(*a*) and (*b*) show horizontal and vertical image forming models respectively obtained when the present invention is embodied where misconvergence is corrected and a dynamic voltage is applied to the second focusing grid 20. In the horizontal model, the electron beam 21 is focused by the effect of a lens electric field 25*a* generated between the first and the second focusing grids 19 and 20 when the deflection angle of the electron beam is widened, At this time, the focusing effect of the main lens electric field 22*a* is reduced because the potential of the second focusing grid 20 becomes close to that of the anode 13 due to the applied dynamic voltage. However, the overall focusing effect including the lens electric field 25*a* is so great that the electron beam 21 is focused at one spot on the phosphor screen 14 after the effects by the divergent lens 23*a* produced by the four-pole magnetic field and by the divergent lens 24*b* produced by the deflection magnetic field. In the vertical model, the electron beam 21 is diverged by the effect of a lens electric field 25*b* generated between the first and the second focusing grids 19 and 20. At this time, the focusing effect of the main lens electric field 22*a* is also reduced as described above. Thus, the electron beam 21 is focused at one spot on the phosphor screen 14 after the effects by the convergent lens 23*b* produced by the four-pole magnetic field and the convergent lens 24*b* produced by the deflection magnetic field, allowing virtually complete circle-shaped beam spots to be formed over the whole area of the phosphor screen 14.

In the above embodiment, the top unit is provided with magnetic members which are magnetically coupled with the pair of dynamic convergence yokes. However, similar effects to the above-described can be obtained without such magnetic members by applying an appropriate current for misconvergence correction and an appropriate dynamic voltage.

Figure 16:
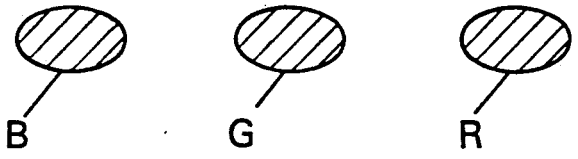
FIG. 16 is a sectional view of horizontally prolonged electron beams.

In the color CRT of this construction, the misconvergence caused by substantial uniformity of horizontal and vertical deflection magnetic fields can be corrected by means of dynamic convergence. Furthermore, the first and second focusing grids are provided with non-circular electron beam passage holes in the side plates facing each other, respectively, and the second focusing grid is given a dynamic voltage which increases as the deflection angle of electron beams is widened, thereby causing each lens electric field, focusing horizontally and diverging vertically, between the first and second focusing grids. Moreover, a focusing effect of a main lens electric field generated between the second focusing grid and the anode is weakened as the deflection angle of electron beams is widened. This enables offsetting the horizontally prolonged distortion in the sectional shape of three electron beams as shown in FIG. 16 caused by the leaked four-pole magnetic field from the pair of dynamic convergence yokes.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A color CRT unit comprising a color CRT incorporating an in-line type electron gun in its neck portion, the in-line type electron gun including three horizontally aligned cathodes, a control grid, an accelerating grid, a first focusing grid, a second focusing grid and an anode a deflection yoke disposed on the color CRT so as to generate substantially uniform horizontal and vertical deflection magnetic fields, and a pair of dynamic convergence yokes disposed near the front portion of the in-line type electron gun so as to apply a horizontal outward deflection force to two side electron beams, the first focusing grid receiving a predetermined focusing voltage while the second focusing grid receiving a superimposed voltage on the focusing voltage of a dynamic voltage which increases as the deflection angle of electron beams becomes widened, the first focusing grid having three in-line electron beam passage holes in the vertically prolonged non-circular shape in the side plate thereof facing the second focusing grid, the second focusing grid having three in-line electron beam passage holes in the horizontally prolonged non-circular shape in the side plate thereof facing the first focusing grid.

2. A color CRT unit according to claim 1, wherein each of the first focusing grid and the second focusing grid is at least partly cylindrical.

* * * * *